US012390688B2

(12) United States Patent
Kennedy

(10) Patent No.: US 12,390,688 B2
(45) Date of Patent: Aug. 19, 2025

(54) FACIAL MUSCLE EXERCISING DEVICE AND METHODS OF USING SAME

(71) Applicant: Beauty Balloon LLC, St. Petersburg, FL (US)

(72) Inventor: Catherine Kennedy, St. Petersburg, FL (US)

( * ) Notice: Subject to any disclaimer, the term of this patent is extended or adjusted under 35 U.S.C. 154(b) by 103 days.

(21) Appl. No.: 18/505,410

(22) Filed: Nov. 9, 2023

(65) Prior Publication Data

US 2025/0152997 A1 May 15, 2025

(51) Int. Cl.

*A63B 23/03* (2006.01)
*A63B 21/002* (2006.01)
*A63B 21/02* (2006.01)

(52) U.S. Cl.

CPC ..... *A63B 23/032* (2013.01); *A63B 21/0023* (2013.01); *A63B 21/028* (2013.01)

(58) Field of Classification Search

CPC ..... A63B 21/0023; A63B 21/028; A63B 21/0004; A63B 21/00178; A63B 21/02; A63B 21/026; A63B 21/0442; A63B 21/045; A63B 21/05; A63B 21/4003; A63B 23/032; A63B 23/025; A63B 23/03

See application file for complete search history.

(56) References Cited

U.S. PATENT DOCUMENTS

| | | | | |
|---|---|---|---|---|
| D277,031 | S * | 1/1985 | Panicci | D24/194 |
| 6,203,471 | B1 * | 3/2001 | Akihiro | A63B 23/032 128/859 |
| D552,745 | S * | 10/2007 | Beckman | D24/194 |
| 10,569,128 | B2 * | 2/2020 | Hirschinger | A63B 23/032 |
| 2010/0190611 | A1 * | 7/2010 | Machida | A63B 21/028 482/11 |
| 2013/0260963 | A1 * | 10/2013 | Takashi | A63B 23/032 482/11 |
| 2019/0059328 | A1 * | 2/2019 | Crane | A01K 15/026 |
| 2022/0233913 | A1 * | 7/2022 | McGhee | A63B 23/032 |

* cited by examiner

*Primary Examiner* — Megan Anderson
(74) *Attorney, Agent, or Firm* — Harpman + Harpman

(57) ABSTRACT

Exercising methods using an exercising device to strengthen, tighten and tone midface, lower face, orofacial, oropharyngeal including the tongue and floor of mouth muscles for both aesthetic and rehabilitative therapeutic practices is disclosed. The exercising device having an angular tubular opening shaped body member of a primary triangular configuration. The shaped body defines a central opening with equal, compressible, and bendable body members there about for designated placement to perform isometric and isotonic muscle resistance training for a variety of facial and tongue exercises. And methodology with universal placement under the lower lip, upper lip, both lips, unilateral or bilateral cheeks, in and around the outer region of the mouth, inside the oral cavity for hard palate, surface of the tongue and floor of mouth engagement.

7 Claims, 11 Drawing Sheets

FACIAL MUSCLE EXERCISING DEVICE AND METHODS OF USING SAME

BACKGROUND OF THE INVENTION

1. Technical Field

The present invention relates to the field of exercising facial muscles, and more specifically to a facial exercise device used to strengthen, tighten, and tone midface, lower face, orofacial, oropharyngeal and floor of mouth muscles of a user.

Background

Throughout history, various cultures have explored techniques to enhance facial aesthetics through non-invasive methods such as facial exercise and massage. These practices aim to rejuvenate the aging face by restoring a more youthful appearance. The modern-day advances in medicine, technology and science have paved the way for solutions to the aging face that harness not only the aesthetic benefits but also the functional and health benefits of facial exercise. In particular, many functional and health benefits are seen with exercise to strengthen the orofacial and oropharyngeal muscles which are widely established in many rehabilitative therapeutic practices. Aesthetic benefits of facial exercise work to restore the underlying structure of the face to improve facial contours, shape, and lost volume resulting in a more youthful appearance. The functional and health benefits of facial muscle exercise are most notably observed within rehabilitative therapeutic practices for such conditions as stroke, Bell's palsy, and dysphagia. Specific exercises are performed in order to rehabilitate facial and oral muscle function, as well as to restore facial symmetry and balance for aesthetic benefits. Myofunctional therapeutic practices for the treatment of Orofacial Myofunctional Disorders (OMDs) and Sleep-Related Breathing Disorders (SRBDs) has shown to improve the dynamic muscle discord (DMD) that is associated with these disorders due to chronic mouth-breathing. Habitual mouth-breathing can cause the orofacial and oropharyngeal muscles to weaken, and atrophy which can lead to episodic partial or complete collapse of the upper airway during sleep resulting in apneic events. By restoring the harmonic balance of the orofacial and oropharyngeal muscles, SRBDs including the current epidemic in the US, Obstructive Sleep Apnea (OSA), and the common condition of snoring can be improved with muscle exercise to strengthen, tighten, and tone the orofacial, and oropharyngeal muscles including the tongue and floor of mouth muscles to restore proper nasal breathing. OSA represents an example of a SRBD in which orofacial and oropharyngeal DMD can lead to serious health consequences such as hypertension, diabetes, or sudden death. In addition, undesirable facial anatomic changes due to chronic mouth-breathing occur in SRBDs and OMDs due to different muscle engagement when mouth-breathing versus nasal breathing. Accordingly, a novel facial muscle exercise device and method for a variety of both isometric and isotonic resistance training exercise therein set forth to strengthen, tighten and tone orofacial, oropharyngeal and floor of mouth muscles may help improve the current epidemic of OSA and improve the undesirable facial anatomic changes associated with SRBDs and OMDs due to chronic mouth-breathing, thereby, imparting improved facial aesthetic outcomes of a user.

The current facial muscles exercise devices that fit into the mouth have moving parts which can be confusing and for the most part are complicated to use and therefore present several challenges and disadvantages to users. Some devices may require users to perform intense or repetitive facial movements which could potentially lead to over exertion or strain on the delicate facial muscles. Over exertion may result in discomfort, pain, or even worsen certain underlying medical conditions such as Temporomandibular Dysfunction (TMD). Other devices are limited in their overall scope of use, failing to target critical muscles needed for facial aesthetic rejuvenation or rehabilitative therapeutic practices in SRBD's and OMD's including OSA and snoring.

2. Description of Prior Art

Prior art patents related to facial exercise devices developed for strengthening facial muscles by providing different resistant inducing structures, see for example U.S. Pat. Nos. 5,556,357, 5,919,116, 6,409,404, 7,462,132, 7,476,180, 7,887,461, U.S. Publication 2014/0141938 and D929,510.

In U.S. Pat. No. 5,556,357 discloses a face, neck and chin exercise having a guard strip and a grip piece for holding strip in position during mouth movements and forming an O and a smile.

U.S. Pat. No. 5,919,116 claims an exercise device for facial muscle and mouth with oppositely disposed mouth engagement components interconnected by a resilient component for repetitive lateral compression.

U.S. Pat. No. 6,406,404 illustrates a facial muscle exercising device having a pair of lip engaging members in longitudinal orientation to urge apart by compressible central spring.

U.S. Pat. No. 7,462,132 claims an exercise device for facial muscles comprising a bifurcated armature with registering engagement pads adapted to receive teeth with an interlinking adjustment.

U.S. Pat. No. 7,476,180 discloses an exercise device for the jaw and facial muscles with a pair of hinged mouth engagement plates with corresponding formed channels for upper and lower teeth.

U.S. Pat. No. 7,887,461 is directed to a lip strengthening device having a hinged articulating axis with a biasing spring there between. Lip engagement arms each position the device either vertically or horizontally between the user's lips.

U.S. Patent Publication 2016/0141939 discloses a face and lip exerciser and methods of use having an elongated body member with lip mouth insert lip engagement and a light insertion point handle extending therefrom.

U.S. Design Pat. D929,510 shows an annular design for a lip engagement device with a pair of lip extension arms interconnected by resilient interim element.

SUMMARY OF THE INVENTION

A facial muscle exercising device and a variety of methods for both isometric and isotonic resistance training to strengthen, tighten and tone midface, lower face, orofacial, oropharyngeal and floor of mouth muscles for both aesthetic benefits and rehabilitation therapeutic practices of a user thereof is disclosed.

The primary embodiment of the facial muscle exercising device comprises a triangle shaped body for placement into different anatomic spaces in and around the mouth, oral cavity, lips, and cheeks for unilateral or bilateral use. The device can be place in the cheeks, unilaterally or bilaterally, under the upper lip, lower lip or both lips. The device can be placed across the lower teeth, back teeth, placed inside the oral cavity to contact the hard palate, surface of the tongue or floor of mouth below the lower teeth of the user. The triangle shaped body member has a flexible and compressible tubular configuration with three interlinked portions. The three portions define a triangle and each portion of the tubular body member presents a side of the triangle. The three portions define a center opening through which the tongue can protrude to perform a variety of resistance training exercises to strengthen the oropharyngeal muscles including the tongue and floor of mouth muscles. The invention is used for both isometric and isotonic resistance training for the midface, lower face, orofacial, oropharyngeal, including the tongue and floor of mouth muscles.

DETAILED DESCRIPTION OF THE INVENTION

Figure 1:
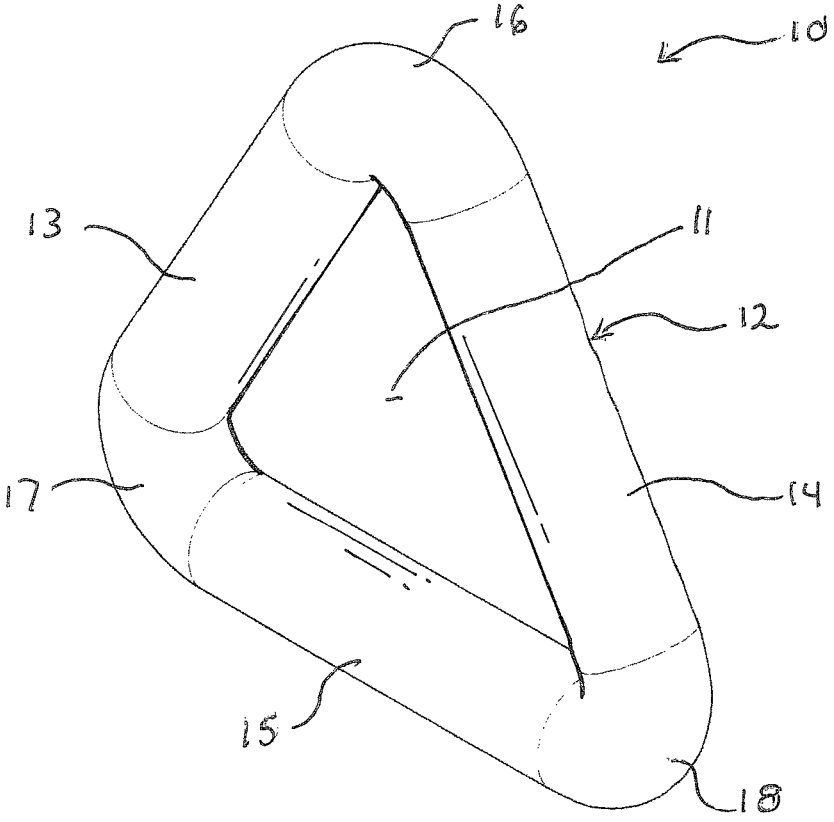
FIG. 1 is a perspective view of the facial muscle exercising device of the invention

The following detailed description refers to the accompanying drawings whenever possible, the same reference numbers are used in the drawings and following the descriptions and refer to the same or similar elements. While disclosed embodiments may be described, modifications, adaptations and implementations are also possible. Accordingly, the following detailed description does not limit the disclosed embodiments. Instead, the proper scope of the disclosure and embodiments is defined by the appended.

The disclosed embodiments improve upon the prior art, a stand-alone facial muscle exercising device 10 of the invention improves over the prior art by providing a device that occupies less space and volume inside the mouth for much user versatility. The facial muscle exercising device 10 has a body made of a flexible and compressible tubular structure that defines a center opening in the body occupying less space and volume, thereby augmenting the effectiveness of the device 10 within and around the mouth so to reposition the device into multiple anatomic spaces for a variety of exercises. The facial muscle exercise device 10 provides the central opening at 11 that allows a user to engage the device with the tongue T and easily reorient the device inside or around the mouth for a variety of orofacial, oropharyngeal and floor of mouth exercises. Facial muscle exercising device 10 improves over prior art providing a soft flexible resilient body that facilitates facial exercises for both aesthetic and rehabilitative therapeutic practices as aforementioned.

Referring specifically now to FIGS. 1-10 of the drawings, the facial muscle exercise device 10 can be seen for strengthening midface, lower face, orofacial, oropharyngeal including tongue and floor of mouth muscles of the user U for both aesthetic and rehabilitative therapeutic practices. As noted, the facial exercise device 10 comprises a flexible and compressible triangle shaped tubular body member 12 formed, in this example, of intersecting tubular elements 13, 14 and 15 defining a triangle wherein the elements 13 and 14 define sides of the triangle and at an apex A and the element 15 defines the base as in integral and stable one-piece construction.

As discloses herein the triangle shaped body 12 is made of a single flexible and compressible tubular element, however, it is understood that the triangle body may also be made by joining two or more flexible tubular elements together. It is understood that for term of disclosure that the facial muscle exercise device has been used interchangeably throughout the application.

The triangle shaped body member 12 has three vertices 16, 17 and 18 and each element forms an angle with an adjacent portion at a vertex between the two elements. For example, the element 13 forms an angle of less than ninety degrees with the adjacent portion 15 and the vertex 17. In an embodiment all three angles between the elements 13, 14 and 15 are the same as sixty degrees and the triangle is an equilateral triangle. However, it is understood that different angles between the elements 13, 14 and 15 to have different types of triangles including but not limited to isosceles, scalene, and obtuse are also covered within the scope of the present invention.

Figure 2:
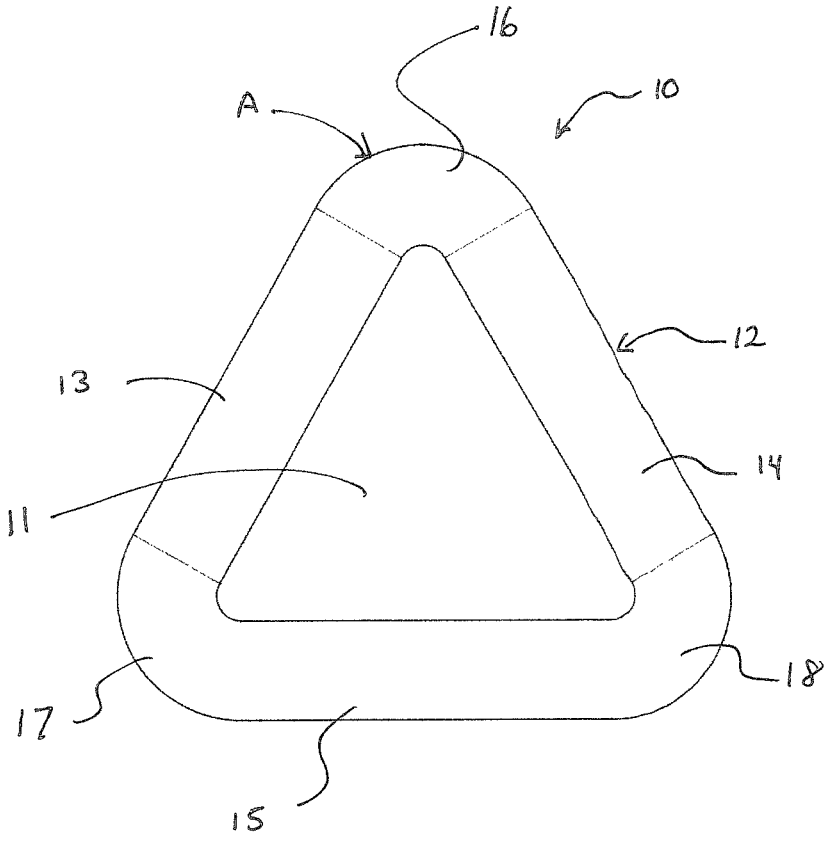
FIG. 2 is a front elevational view thereof.
Figure 3:
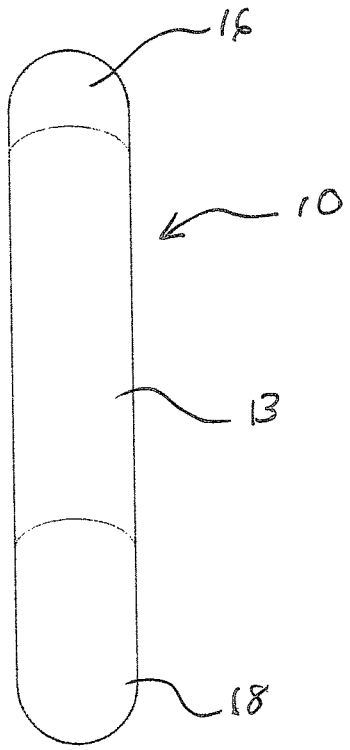
FIG. 3 is a left side elevational view thereof.

As shown in FIGS. 1 and 2 of the drawings, three elements 13, 14 and 15 define the center opening 11 in the triangle shaped body 12. The center opening 11 allows the user to engage facial muscle exercise device 10 with the tongue T illustrated in FIGS. 10, 11, 12, 13, 14 and 15 with the placement of the device inside or around the mouth to assist in a variety of isometric and isotonic resistance training exercises for the orofacial, and oropharyngeal muscles including the tongue and floor of mouth muscles with much ease by a user. Flexible tubular body member 12 is made, in this example, of resilient medical grade material such as thermoplastic polyethylene (TPU), thermoplastic elastomer (TPE) or silicone.

The resilient nature of the tubular material provides a compliant structure that retains shape during user engagement for both isometric and isotonic resistance training as will be described in greater detail hereinafter. It is understood that both isometric and isotonic exercises are performed in repetition in each example.

In operation, method steps using defined placement and users' completion of interactive exercise repetitions enabled thereby. Representative examples of exercise device placement to perform isometric and isotonic resistance training exercises are as follows.

Figure 5:
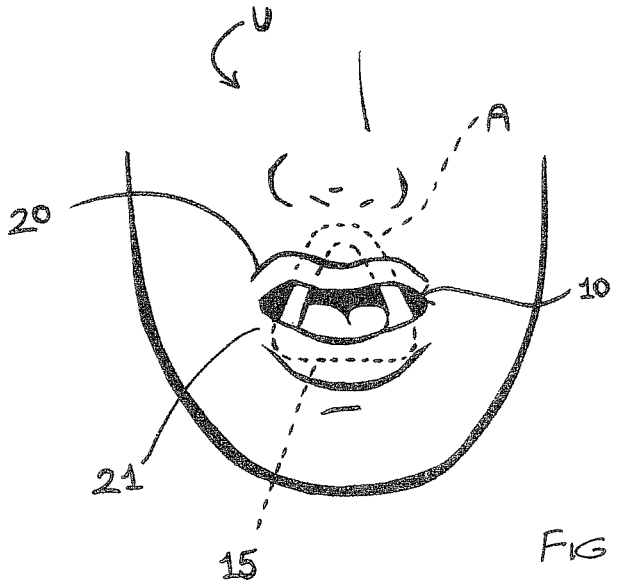
FIG. 5 is a partial graphic facial illustration of a user's mouth with the invention in use with its apex under the mid upper lip and base under the lower lip.

Referring now to FIG. 5 of the drawings, the placement of facial muscle exercise device 10 apex a is positioned under upper lip 20 and device 10 base 15 under lower lip 21 of the user U. The user U contracts the lips 20 and 21 against resistance of device 10.

In the above described and illustrated placement and use of the facial muscle exercise device 10 the user can vocalize the letter "O", then the letter "E" to assist with exercise performance.

Figure 4:
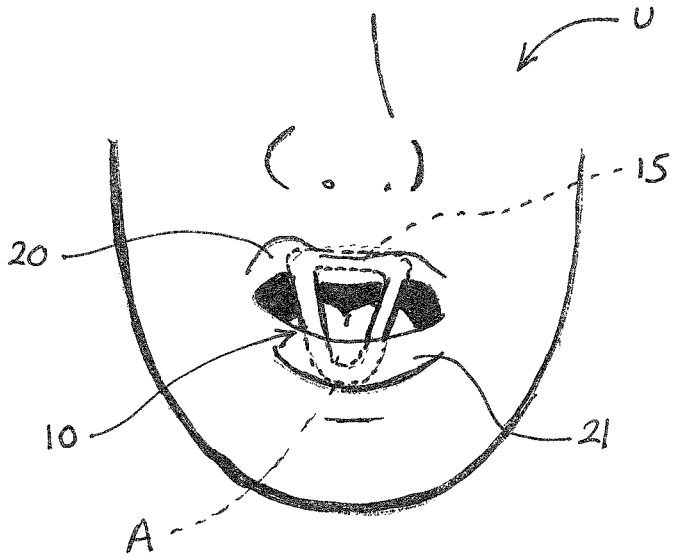
FIG. 4 is a graphic perspective illustration of the facial muscle exercising device in use with its base under the upper lip and apex under the lower lip.

Alternately, the facial exercise device 10 can be rotated 180 degrees as seen in FIG. 4 of the drawings with the base 15 placed under the upper lip 20 and apex A placed under the lower lip 21.

Figure 6:
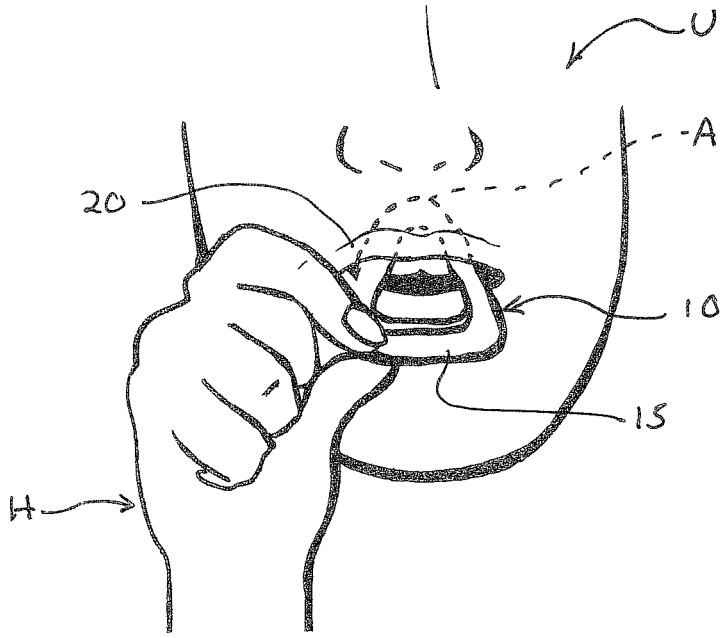
FIG. 6 is a partial graphic facial illustration of a user's mouth with the invention in use with its apex under the mid upper lip and held in place by the user's hand.
Figure 7:
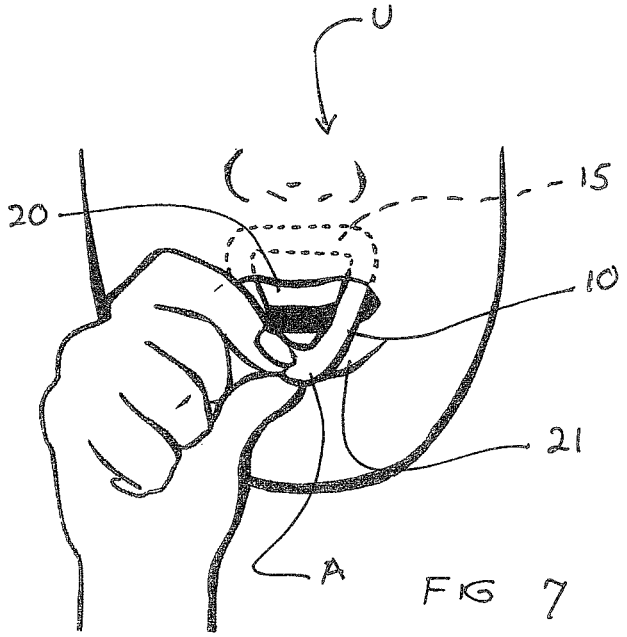
FIG. 7 is a partial graphic facial illustration of a user's mouth with the invention in use with the base under the entire upper lip and held in place by the user's hand.

It will be seen therefore that alternate facial exercises can be achieved by varying the strategic placement and orientation of the triangle facial exercise device 10 inclusive of under one lip alternating as illustrated graphically in FIGS. 6 and 7 of the drawings by placing the facial exercise device 10 apex A in FIG. 6 under the upper lip 20 and contracting the lip over the apex A of the device as the user's hand H holds the base 15 to maintain device 10 placement, then intermittently also verbalizing the letter "O" and "E" to assist with exercise performance. Alternately, in FIG. 7 the facial exercise device 10 is rotated 180 degrees with the base 15 of the device under the entire upper lip width 20 while user's hand holds device in place at the apex A demonstrating much versatility, as seen in the drawings.

Figure 8:
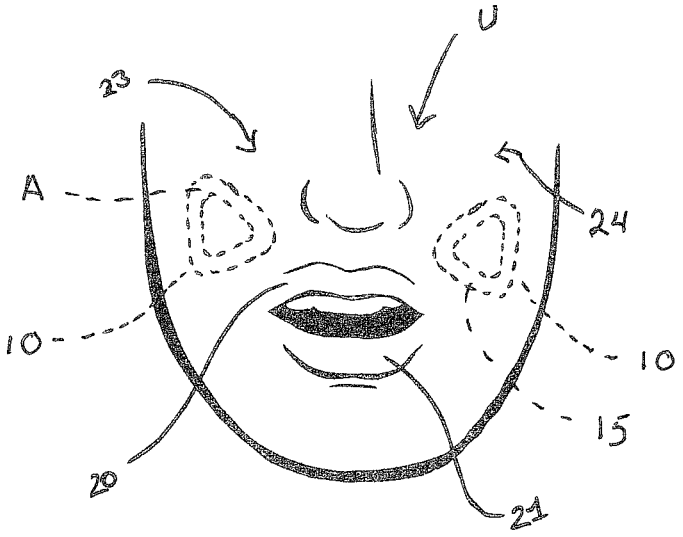
FIG. 8 is a partial graphic facial illustration of a user's mouth with bilateral cheek placements of the invention.

Referring to FIG. 8 of the drawings, the facial muscle exercise device 10 is placed into the left and right cheeks 23 and 24 bilaterally to vocalize the letter "O" then the letter "E" to assist with exercise performance.

The utilization of one facial muscle exercise device 10 positioned, as noted, unilaterally or bilaterally in the cheeks to suck cheeks inward contracting over the resistance of the facial muscle device 10.

Figure 9:
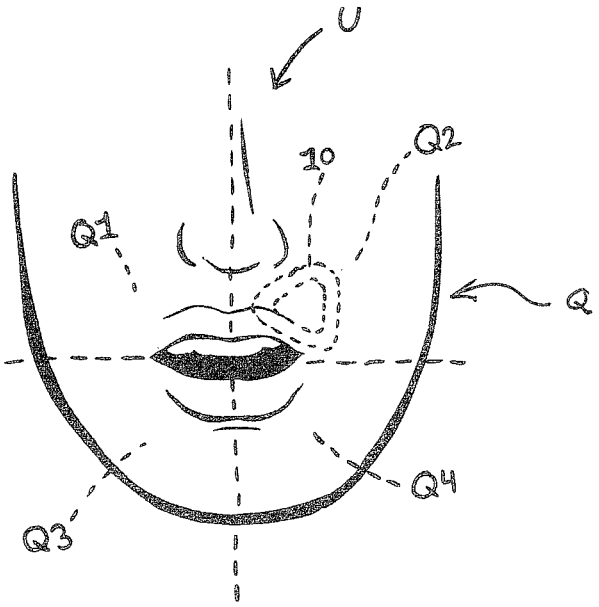
FIG. 9 is a partial graphic facial illustration of a user's mouth with the invention in the left upper lip quadrant for isolation of the left upper lip, it follows that other quadrants can be isolated to target the desired lip muscle segment to exercise.

Referring now to FIG. 9 of the drawings, the facial muscle exercise device 10 is illustrated with select placement in multiple quadrants Q of the lip muscle, in this example designated by the letters and numbers Q1, Q2, Q3 and Q4. Placement in selected quadrant Q2 is illustrated with contraction of the left upper lip 20 over the apex A of the facial exercise device 10 with concomitant placement of fingertip, not shown, on oppositely disposed area to prevent contraction so to ensure only the desired left upper lip segment is exercised. It follows that other quadrants can be isolated as desired to exercise.

It will be evident that the facial muscle exercise device 10 can be used universally used for a variety of both isometric and isotonic resistance training exercise for the midface, lower face, orofacial, oropharyngeal including the tongue and floor of mouth muscles to which can only be accomplished by its unique versatility of use.

Figure 10:
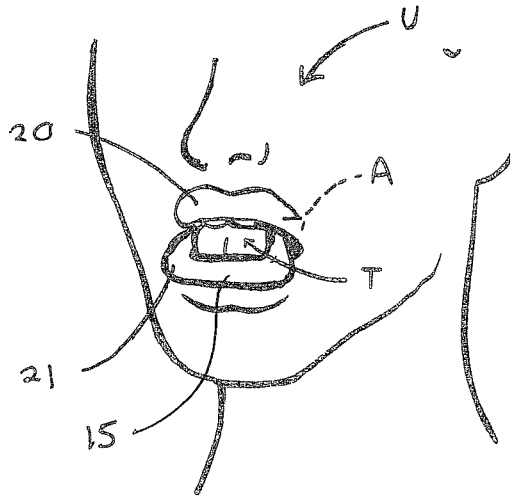
FIG. 10 is a partial perspective facial illustration of a user pressing device apex up against the hard palate with the tongue.
Figure 11:
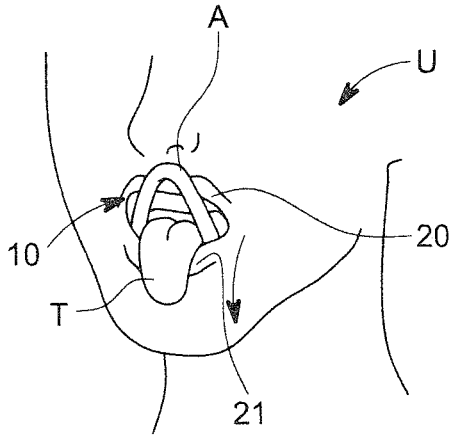
FIG. 11 is a partial perspective facial illustration with the user's tongue extending through invention to contract down against the resistance of the invention's base as the device base remains in place across the lower teeth.
Figure 12:
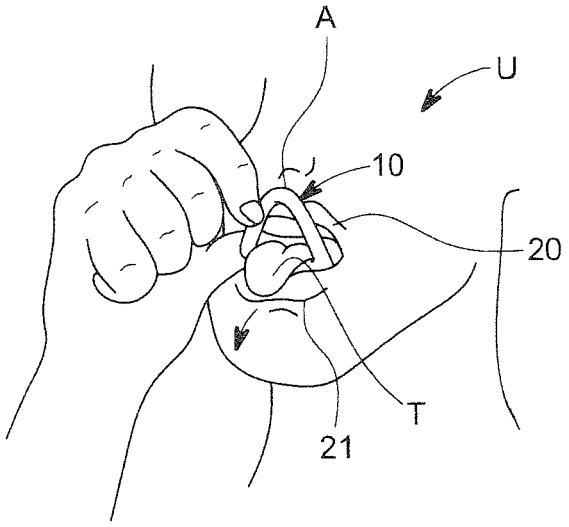
FIG. 12 is a partial perspective facial illustration with the user's tongue through exercise device extending there through against the inner resistance of device and then retracting tongue (not shown) to repeat exercise.

Examples of device 10 versatility of use is further illustrated in FIGS. 10-12 of the drawings directed to the user's tongue T to strengthen, tighten, and tone the oropharyngeal and floor of mouth muscles.

FIG. 10 characterized by the tongue T, pushing device 10 apex A up against the hard palate for resistance inside the mouth while the teeth gently bite device 10 to hold in position.

In FIG. 11 the tongue T protrudes straight through the triangle and contracts down against resistance of base 15 as it rests across the lower teeth, not shown, protecting the undersurface of the tongue from the lower teeth.

In FIG. 12 the tongue T holds the apex A in place along the floor of mouth behind the lower teeth, not shown. The tongue T can also hold device 10 in the same position, but with tongue through triangle into lower lip space. For greater exercise challenge the tongue can slide device 10 side to side to augment further these tongue and floor of mouth exercises.

A variety of facial muscle strengthening, tightening and toning exercises are achieved for aesthetic and rehabilitative therapeutic practices. Muscles of the oropharynx including the tongue are strengthened to improve the DMD that is associated with SRBDs and OMDs including the epidemic OSA and the common condition of snoring as a result of nighttime chronic mouth-breathing.

The mechanism of action of device 10 is twofold, first, device 10 increases the range of motion enabling muscle fibers to work most effectively thereby increasing muscle blood flow. Second, device 10 provides the resistance for isometric and isotonic resistance training exercise. Correspondingly, many aesthetic and health benefits are gained with use of device 10. For example, by reaching the deep muscle fibers of the lip muscle, the sphincter component of the lip muscle, poor lip seal strength commonly associated with mouth-breathing, dysphagia and stroke can be improved. Poor lip seal strength resulting from chronic mouth-breathing contributes to SRBDs and OMDs including OSA, and snoring as well as dysphagia and stroke associated drooling. Improving lip seal strength with the use of device 10 can help to improve SRBDs, and OMDs including OSA, and snoring as well as rehabilitate dysphagia and stroke associated drooling. Accordingly, the aesthetic benefits of a strong lip seal include improvement in lip volume and structure. There is improvement in lip contours, shape, and symmetry as a result of muscle hypertrophy from resistance training. The corners of the mouth are lifted, undesirable vertical lip lines are improved and a desired shortening of the upper lip philtrum may be achieved as a result of hypertrophy of the lip muscle with use of device 10. Subsequently, use of device 10 for cheek enhancement results in lifted, sculpted and revolumized cheeks as the mid, lateral and lower cheek muscles are strengthened, tightened and toned. The variety of tongue, floor of mouth and neck muscle exercises accomplished with the use of device 10 results in a more defined jawline, improvement in the cervicomental angle, less visible tech neck lines and improvement in the undesirable double chin as the orofacial, oropharyngeal, floor of mouth and neck muscles are tightened and toned through isometric and isotonic resistance training.

Figure 13:
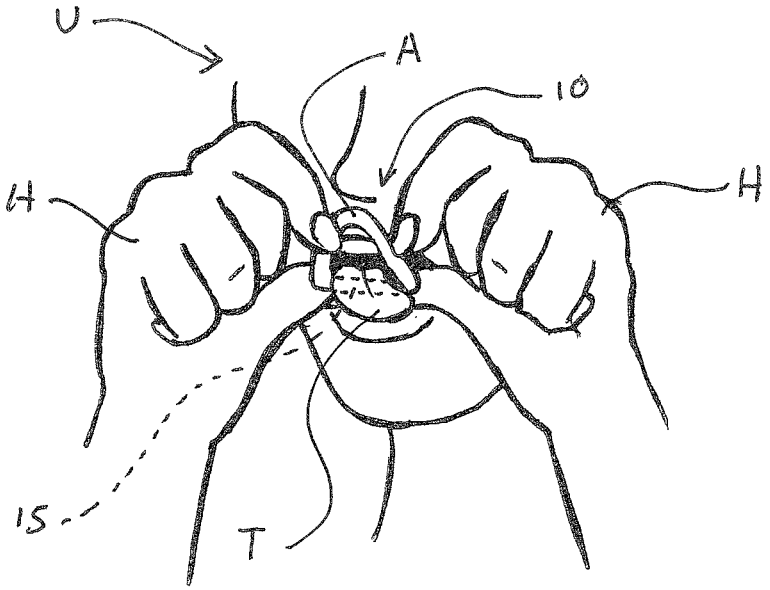
FIG. 13 is a partial perspective facial illustration with the invention being held by the user with the tongue extending there through as the tongue slides side to side as the user's hands move device in opposite direction for transverse tongue resistance.
Figure 14:
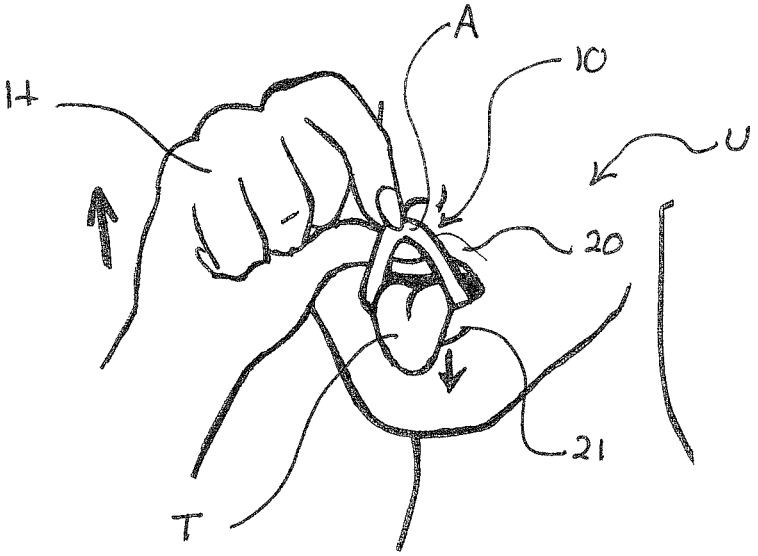
FIG. 14 is a partial perspective facial illustration with the exercise device base across the lower teeth with tongue extended there through as user tugs upward on device apex adding more resistance as tongue holds the device base across the lower teeth.
Figure 15:
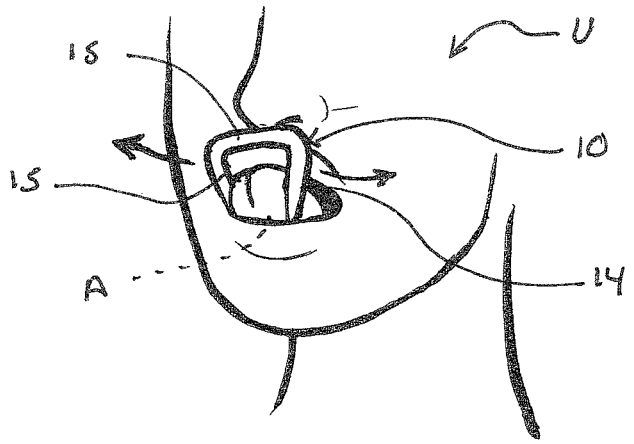
FIG. 15 is a partial perspective facial illustration with the exercise device apex placed on the floor of the mouth behind the lower teeth and the tongue extends there through to hold device in place, also tongue can move device side to side for greater resistance.

Referring now to FIGS. 13-15 of the drawings, alternate tongue exercises can be seen using device 10 of the invention wherein in FIG. 13 illustrates a tongue slide exercise. The tongue T protrudes through the opening in the triangle at 11 while the user's hands H engage the respective oppositely disposed angular sides of the device 13 and 14 and the base 15 thereby pushing device 10 in opposite direction of the tongue's side to side movement to augment transverse resistance against the tongue.

FIG. 14 of the drawings shows a tongue plank apex A tug exercise wherein the user U positions the device 10 base 15 across the lower teeth holding device 10 by its apex A. The tongue T extends through the center opening 11 down against the base 15. The user tugs device 10 apex A upward to add more resistance against the tongue T as the tongue resists the upward tug at the apex to keep device 10 base 15 across the lower teeth.

In FIG. 15 of the drawings, the device 10 is inverted with the apex A placed on the floor of the mouth behind the lower teeth. The tongue Tis then extended through the opening 11 to touch the floor of mouth and then slides device 10 from side to side against the respective device's 10 sides 13 and 14 thereby imparting transverse resistance thereto.

Figure 16:
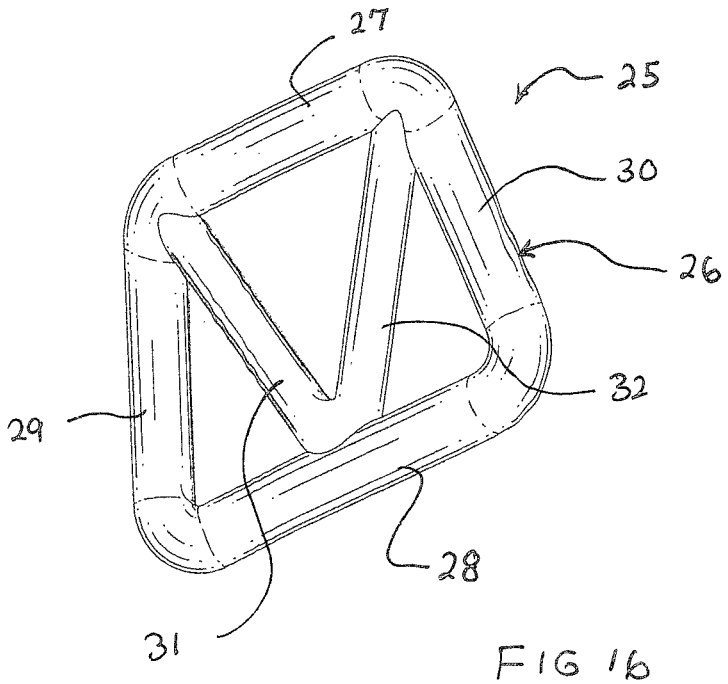
FIG. 16 is a perspective view of an alternate embodiment of the facial muscle exercising device.

Referring now to FIG. 16 of the drawings, an alternate embodiment of the facial muscle exercise device 25 of the invention can be seen having a resilient tubular main body member 26 with spaced horizontal upper and lower elements 27 and 28 interconnected by angular end side elements 29 and 30. A pair of secondary support and connecting angular elements 31 and 32 define an inner adjoining apex with the upper element 27 midway there between and spaced engagement with the base element 28. The so defined multiple angular connecting elements impart enhanced stability, resistant support to the main body member 26 assuring proper resistant performance in use applications as hereinbefore disclosed with the primary embodiment 10.

Figure 17:
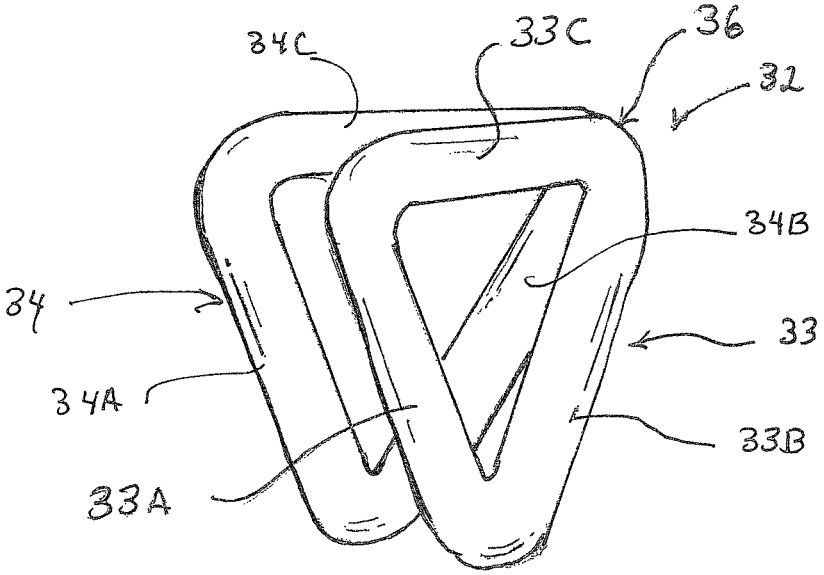
FIG. 17 is a perspective view of a second alternate embodiment thereof.

Referring now to FIG. 17 of the drawings, a second alternate embodiment of the facial muscle exercise device 32 can be seen having a resilient tubular first main body member 33 and a second tubular resilient body member 34 joined together.

The first tubular body member 33 has a pair of angular interconnecting elements 33A and 33B joined by an upper interconnecting element 33C. The second tubular body element 34 has corresponding angular elements 34A and 34B interconnected by an upper tubular body member element 34C. The two respective body members 33 and 34 are joined at the intersection of their respective angular elements 33B and upper element 33C and 34B and 34C at a point designated at 36.

These two alternate forms can be used in similar applications for effective exercise by placement previously indicated with the advantages of the alternate form 32 providing improved application due to its dual configuration as will be understood by those skilled in the art.

It will be evident from the above descriptions and examples that a variety of non-illustrated exercises can also be achieved by strategic placement of the facial muscle exercise device 10 that will benefit users for both aesthetic and health related purposes as seen in rehabilitative therapeutic practices as described herein above.

Thus, it will be seen that a new and novel facial muscle exercise device has been illustrated which provides aesthetic and health related benefits users and it will be apparent to those skilled in the art that various changes and modifications may be made therein without departing from the spirit of the invention.

Therefore, I claim:

1. A method of select isometric and isotonic resistance exercises for aesthetic and rehabilitative therapeutic practices for midface, lower face, orofacial, oropharyngeal including the tongue and floor of mouth muscles comprises the steps of, a. providing a triangularly shaped tubular resilient body member, b. positioning said triangularly shaped tubular resilient body member into select positions of mouth and cheeks of a user, c. holding said triangularly shaped tubular resilient body member in alternate under and over the lip of said user's mouth, d. repeatedly engaging said triangularly shaped tubular resilient body member with isometric and isotonic resistance training exercises of said user's midface, lower face, orofacial, oropharyngeal including said tongue and floor of mouth muscles in prescribed sequences and duration to strengthen, tighten and tone desired muscles, e. alternating the position of said triangularly shaped tubular resilient body member for unilateral and bilateral specific muscle engagement by repetitive sequence facial movements including verbalizations of the user, f. positioning said triangularly shaped tubular resilient body member for external engagement of the tongue of the user there through an opening defined by said triangularly shaped tubular resilient body member in multiple tongue extended positional orientations and durations.

2. The method of claim 1 wherein the step of providing a triangularly shaped tubular resilient body member, the triangularly shaped tubular resilient body member comprises, a yielding tubular body having multiple interlinking portions with a base, adjoining upstanding angularly disposed side portions defining an apex of said triangularly shaped tubular resilient body member.

3. The method of claim 1 wherein said step of engaging said triangularly shaped tubular resilient body member by isometric and isotonic facial movements comprises, contracting muscles for compressing engagement against surfaces of said triangularly shaped tubular resilient body member between respective lips, gums, and inner cheeks of the user unilaterally and bilaterally.

4. The method of claim 1 wherein the step of positioning said triangularly shaped tubular resilient body member for external engagement of the tongue of the user there through comprises, said triangularly shaped tubular resilient body member base across lower teeth of the user, extending the tongue of the user through said opening, retraction of said tongue, contacting the tongue of the user down on triangular base of said triangularly shaped tubular resilient body member, rest across said lower teeth, to hold, release and repeat.

5. The method of claim 1 wherein said step of positioning said triangularly shaped tubular resilient body resilient body member for extension of the tongue of the user there through further comprises, placing said triangularly shaped tubular resilient body member across user's teeth biting gently down, extending the tongue of the user through said opening, compressing said triangularly shaped tubular resilient body member respective apex and base up towards hard palate of said user with the tongue to repeat multiple times.

6. The method of claim 1 wherein the step of positioning said triangularly shaped tubular resilient body member for extension of the tongue of said user there through further comprises, holding said triangularly shaped tubular resilient body member in position and moving the tongue for select transverse resistant engagement against said triangularly shaped tubular resilient body member.

7. The method of claim 1 wherein said the step of repeatedly engaging said triangularly shaped tubular resilient body member by isometric and isotonic facial movements of the mouth of the user further comprises, positioning said triangularly shaped tubular resilient body member in inner cheeks of said user, straddling respective upper and lower gums of said user, keeping lower teeth slightly apart, repetitively sucking said cheeks inwardly contracting over the resistance of said triangularly shaped tubular resilient body member in its respective unilateral and bilateral cheek placement for multiple times holding and then releasing.

* * * * *